United States Patent [19]

Alexander

[11] Patent Number: 4,619,295

[45] Date of Patent: Oct. 28, 1986

[54] WEAVER'S PLATFORM

[76] Inventor: William J. Alexander, P.O. Box 761, Mauldin, S.C. 29662

[21] Appl. No.: 723,570

[22] Filed: Apr. 15, 1985

[51] Int. Cl.[4] ..... D03D 49/20

[52] U.S. Cl. ..... 139/304; 57/291; 242/35.5 R

[58] Field of Search ..... 139/304, 305, 306, 307, 139/308; 57/290, 291, 315; 242/35.5 R, 35.5 A; 66/149 R; 26/15 R, 70

[56] References Cited

U.S. PATENT DOCUMENTS

| | | | |
|---|---|---|---|
| 2,480,395 | 8/1949 | Clark | 139/304 |
| 3,043,083 | 7/1962 | Noguera | 57/315 |
| 3,769,666 | 11/1973 | Kaufmann | 26/15 R |
| 3,927,844 | 12/1974 | Bond et al. | 26/70 |
| 4,407,332 | 10/1983 | Alexander | 139/304 |

*Primary Examiner*—Henry S. Jaudon

*Attorney, Agent, or Firm*—Bailey & Hardaway

[57] ABSTRACT

A weaver's platform is illustrated having arcuate means extending transversely along each side of the platform facilitating the passage of cloth from the loom beneath the platform to a takeup positioned forwardly of the loom, and a pivotal mounting for the walkway portion of the platform facilitating removal of the platform from the weaver's aisle for clean up.

1 Claim, 2 Drawing Figures

10
11
12
13
14
15
17
18
19
20
21
22
23
24
25
A
B
C
D
F
2

WEAVER'S PLATFORM

BACKGROUND OF THE INVENTION

A weaver's platform is illustrated in U.S. Pat. No. 4,407,332 having arcuate means positioned transversely adjacent each side for facilitating passage of cloth therebeneath the loom of the cloth takeup. The platform is illustrated as positioned upon spaced supports in the form of legs and are carried above the floor in the aisle area between the loom and the cloth takeup which is generally positioned in front of the loom. Due to the permanent positioning of the weaver's platform for providing passage for personnel in the aisle between the loom and the takeup, there is a tendency for trash to accumulate in the aisle area both upon the platform but especially therebeneath.

It is desirable therefore to provide a means for facilitating the clean out of the weaver's aisle area between the loom and a takeup positioned forwardly of the loom.

An important object of the invention is the provision of a weaver's platform having an elongated rectangular walkway which has means for facilitating the passage of cloth therebeneath and which is pivoted to permit the platform to be pivoted upwardly out of the way to facilitate cleanup in the weaver's aisle.

SUMMARY OF THE INVENTION

It has been found that cleanup of the weaver's aisle as between a loom and an off loom takeup positioned forwardly of the loom and utilizing an elongated rectangular walkway for facilitating movement of personnel in the weaver's aisle between the loom and the takeup, may be facilitated by providing a pivotal mounting for the walkway preferably upon the frame of the cloth takeup. It has further been found desirable to provide arcuate supports of curved sheet metal extending transversely along the sides of the walkway to provide rigidity to the walkway and the supports therefor including the pivoted portion of the walkway.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figures 1, 2:
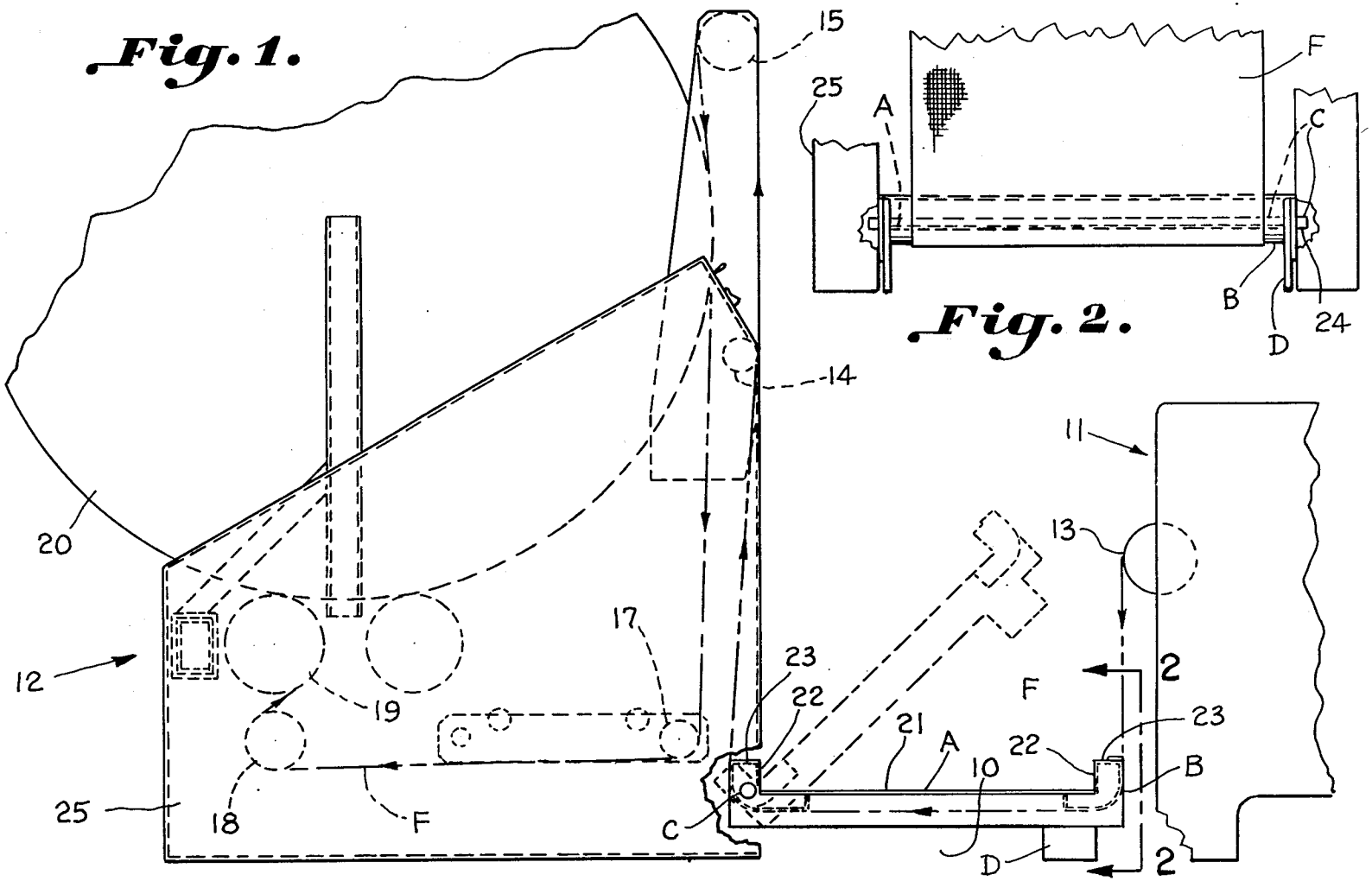
FIG. 1 is a schematic side elevation illustrating a weaver's platform constructed in accordance with the invention positioned in the weaver's aisle between the loom and the takeup positioned forwardly of the loom.
FIG. 2 is a side elevation of the weaver's platform taken from the front looking toward the cloth takeup along the line 2—2 in FIG. 1.

A weaver's platform is illustrated for use in the weaver's aisle area between a textile loom and an off the loom cloth takeup. An elongated rectangular walkway A is disposed between the textile loom and the cloth takeup positioned forwardly of the loom. A pair of spaced arcuate supports B are positioned transversely with one of said supports adjacent each side of the elongated rectangular walkway for facilitating the passage of cloth beneath the walkway and for reinforcing and bracking the walkway for adding rigidity thereto. A transverse pivotal support C is carried adjacent one of the arcuate supports. A support means D is provided for carrying the walkway adjacent the other of the arcuate supports. Thus, the walkway may be pivoted upwardly for easy removal from the aisle for clean out of the area between the loom and the cloth takeup while facilitating passage of cloth from the loom to the takeup.

The drawing illustrates a weaver's aisle 10 positioned forwardly of a loom broadly designated at 11 and a cloth takeup broadly designated at 12 positioned in front of the aisle. The loom 11 has a cloth roll 13 over which the cloth or fabric F precedes downwardly. The cloth F passes thence beneath the weaver's platform including the walkway A and the spaced arcuate guide supports B prior to passing upwardly over the guide roll 14 and thence over the roll 15 of the cloth inspection apparatus prior to passing downwardly and over the oscillatable roll 17 of a constant tension compensator such as illustrated in U.S. Pat. No. 4,216,804. The fabric F passes thence over guide rolls 18 and 19 to the surface wound cloth takeup roll 20.

The elongated rectangular walkway A is illustrated as being constructed of base postion 21 sheet metal or other suitable cloth support sheet material having upturned ends 22 at each end therof. An outwardly extending portion 23 at each end carries an upper portion of the arcuate support B which is preferably constructed of sheet metal. The transverse pivotal support C is illustrated as located above and adjacent an upturned end and as including a shaft 24 for pivotal mounting in the side frames 25 of the cloth roll takeup. Suitable support means D in the form of spaced legs 26 secured adjacent the opposite upturned end are provided for carrying one side of the weaver's platform.

The weaver's platform is illustrated in broken line position in FIG. 1 being raised to what is ultimately a substantially vertical position out of the way for facilitating cleaning the weaver's aisle. It is thus seen that the arcuate support means as well as the pivotal support provides strength and rigidity to the weaver's platform while at the same time serves the additional functions of guiding the cloth for easy passage beneath the platform while permitting removal of same for purposes of cleaning.

While a preferred embodiment of the invention has been described using specific terms, such description is for illustrative purposes only, and it is to be understood that changes and variations may be made without departing from the spirit or scope of the following claims.

What is claimed is:

1. A weaver's platform for use in the weaver's aisle area between a textile loom and an off the loom cloth takeup comprising:

an elongated rectangular walkway disposed between said textile loom and said cloth takeup positioned forwardly of the loom;

a pair of spaced arcuate supports positioned transversely with one of said supports adjacent each side of said elongated rectangular walkway for facilitating the passage of cloth beneath said walkway and for reinforcing and bracing said walkway for adding rigidity thereto;

said walkway including a transverse pivotal support carried adjacent one of said arcuate supports;

a support means for carrying the walkway adjacent the other of said arcuate supports;

said arcuate supports being curved sheet portions; and said walkway being pivoted to said cloth takeup above said adjacent sheet metal portion;

whereby said walkway may be pivoted upwardly for easy removal from the aisle for clean out of the area between the loom and the cloth takeup while facilitating passage of cloth from the loom to the takeup.

* * * * *